US008590155B2

(12) United States Patent
Nilsson et al.

(10) Patent No.: US 8,590,155 B2
(45) Date of Patent: Nov. 26, 2013

(54) APPARATUS FOR AND PROCESS OF FILLING A MUFFLER WITH FIBROUS MATERIAL UTILIZING A DIRECTIONAL JET

(75) Inventors: Gunnar B. Nilsson, Falkenberg (SE); Lennart Svensson, Falkenberg (SE); Stefan Sjunnesson, Falkenberg (SE); Bengt-Erik Ingemansson, Olofstrom (SE); Luc Brandt, Vallee (BE)

(73) Assignee: OCV Intellectual Capital, LLC, Toledo, OH (US)

( * ) Notice: Subject to any disclaimer, the term of this patent is extended or adjusted under 35 U.S.C. 154(b) by 393 days.

(21) Appl. No.: 12/477,396

(22) Filed: Jun. 3, 2009

(65) Prior Publication Data

US 2010/0307632 A1 Dec. 9, 2010

(51) Int. Cl.
*B21D 51/16* (2006.01)
*B65D 1/04* (2006.01)
*F01N 1/24* (2006.01)

(52) U.S. Cl.
CPC ..... *B21D 51/16* (2013.01)
USPC ..... 29/890.08; 141/1; 141/392; 181/256

(58) Field of Classification Search
USPC ..... 141/2, 67, 98, 105, 387, 392, 1; 239/419.5; 181/256, 257; 29/890.08
See application file for complete search history.

(56) References Cited

U.S. PATENT DOCUMENTS 3,149,885 A * 9/1964 Walsh ..... 406/193
3,212,691 A 10/1965 Lockshaw
3,232,557 A 2/1966 Winn, Jr.
3,233,697 A * 2/1966 Slayter et al. ..... 181/245
3,655,862 A 4/1972 Dorschner et al.
3,921,273 A 11/1975 Kondo et al.
3,958,758 A * 5/1976 Piorkowski ..... 239/133
3,964,528 A 6/1976 Smithson et al.
4,148,676 A 4/1979 Paquette et al.
4,215,805 A * 8/1980 Nielsen ..... 226/97.4

(Continued)

FOREIGN PATENT DOCUMENTS

DE 3238638 4/1984
DE 19614147 10/1997

(Continued)

OTHER PUBLICATIONS

International Search Report from PCT/EP02/00954 dated Oct. 1, 2002.

(Continued)

*Primary Examiner* — Timothy L Maust
(74) *Attorney, Agent, or Firm* — Calfee, Halter & Griswold LLP

(57) ABSTRACT

A nozzle for delivering texturized fibrous material into a chamber of a muffler has a body including a texturized fibrous material passageway and a separate directional jet passageway. A method of filling a chamber of a muffler with texturized fibrous material includes the steps of extending a wand into the muffler so that a nozzle on the wand is received in the chamber, discharging a stream of texturized fibrous material into the chamber from a first passageway of the nozzle and discharging a directional jet into the stream of texturized fibrous material from a second passageway of a nozzle whereby the stream of texturized fibrous material is redirected into a desired filling direction to more efficiently fill the chamber.

11 Claims, 6 Drawing Sheets

(56) References Cited

U.S. PATENT DOCUMENTS

| | | | | |
|---|---|---|---|---|
| 4,282,017 | A | 8/1981 | Chen | |
| 4,411,388 | A * | 10/1983 | Muck | 239/419.5 |
| 4,551,955 | A * | 11/1985 | Zion, Jr. | 451/102 |
| 4,569,471 | A | 2/1986 | Ingemansson et al. | |
| RE32,258 | E | 10/1986 | Kondo et al. | |
| 4,700,806 | A | 10/1987 | Harwood | |
| 4,729,513 | A * | 3/1988 | Fetcenko et al. | 239/707 |
| 4,736,817 | A | 4/1988 | Harwood | |
| 4,774,985 | A * | 10/1988 | Broadbelt et al. | 141/12 |
| 4,824,507 | A | 4/1989 | D'Amico | |
| 5,036,585 | A | 8/1991 | Schweinfurth | |
| 5,147,653 | A | 9/1992 | Nelson | |
| 5,398,407 | A | 3/1995 | Stuer | |
| 5,461,777 | A | 10/1995 | Ikeda et al. | |
| 5,479,706 | A | 1/1996 | Tamano et al. | |
| 5,701,737 | A | 12/1997 | Branik et al. | |
| 5,766,541 | A | 6/1998 | Knutsson et al. | |
| 5,783,782 | A | 7/1998 | Sterrett et al. | |
| 5,784,784 | A | 7/1998 | Flanigan et al. | |
| 5,859,394 | A | 1/1999 | Seehaus et al. | |
| 5,907,904 | A | 6/1999 | Gerber et al. | |
| 5,976,453 | A | 11/1999 | Nilsson et al. | |
| 6,053,276 | A | 4/2000 | D'Amico, Jr. et al. | |
| 6,068,082 | A | 5/2000 | D'Amico, Jr. et al. | |
| 6,094,817 | A | 8/2000 | Shah et al. | |
| 6,148,519 | A | 11/2000 | Stenersen et al. | |
| 6,158,547 | A | 12/2000 | Ackerman et al. | |
| 6,241,043 | B1 | 6/2001 | Goertz | |
| 6,317,959 | B1 | 11/2001 | Nilsson et al. | |
| 6,319,444 | B1 | 11/2001 | Kirk | |
| 6,370,747 | B1 | 4/2002 | Lewin et al. | |
| 6,412,596 | B1 | 7/2002 | Brandt et al. | |
| 6,446,750 | B1 | 9/2002 | Lewin | |
| 6,543,576 | B1 | 4/2003 | Cofer et al. | |
| 6,581,723 | B2 * | 6/2003 | Brandt et al. | 181/256 |
| 6,607,052 | B2 | 8/2003 | Brandt et al. | |
| 6,758,998 | B2 | 7/2004 | Debalme et al. | |
| 6,883,558 | B2 * | 4/2005 | Jander | 141/1 |
| 7,077,922 | B2 | 7/2006 | Brandt et al. | |
| 7,165,648 | B2 | 1/2007 | Arsdale | |
| 7,975,382 | B2 * | 7/2011 | Brandt et al. | 29/890.08 |
| 2001/0003624 | A1 | 6/2001 | Lind et al. | |
| 2001/0011780 | A1 | 8/2001 | Knutsson | |
| 2002/0121526 | A1 | 9/2002 | Debalme et al. | |
| 2002/0129991 | A1 | 9/2002 | Lewin | |
| 2003/0042070 | A1 | 3/2003 | Brandt et al. | |
| 2003/0047381 | A1 | 3/2003 | Brandt et al. | |
| 2005/0279570 | A1 | 12/2005 | Van Arsdale | |
| 2009/0110822 | A1 | 4/2009 | Brandt et al. | |
| 2011/0240173 | A1 | 10/2011 | Brandt et al. | |

FOREIGN PATENT DOCUMENTS

| | | |
|---|---|---|
| DE | 102005009045 | 8/2006 |
| EP | 91413 | 10/1983 |
| EP | 106481 | 4/1984 |
| EP | 895815 | 2/1992 |
| EP | 692616 | 1/1996 |
| EP | 926320 | 6/1999 |
| EP | 1902785 | 3/2008 |
| GB | 986377 | 3/1965 |
| GB | 2267731 | 12/1993 |
| JP | 11-013450 | 1/1999 |
| WO | 98/24615 | 6/1998 |
| WO | 99/02826 | 1/1999 |
| WO | 02/060763 | 8/2002 |
| WO | 02/075122 | 9/2002 |
| WO | 03/023201 | 3/2003 |
| WO | 2009/058981 | 5/2009 |
| WO | 2010/141681 | 12/2010 |

OTHER PUBLICATIONS

International Preliminary Examination Report from PCT/EP02/00954 dated Feb. 26, 2003.
International Search Report from PCT/EP02/10185 dated Dec. 19, 2002.
International Preliminary Examination Report from PCT/EP02/10185 dated Mar. 31, 2003.
International Search Report from PCT/US02/07418 dated Jun. 28, 2002.
International Search Report and Written Opinion from PCT/US08/81758 dated Jan. 28, 2009.
International Search Report and Written Opinion from PCT/US10/37202 dated Sep. 29, 2010.
Communication from European Application No. 08844262.9 dated Oct. 21, 2010.
Search Report from European Application No. 02290279.5 dated Jun. 26, 2002.
Office action from Chinese Application No. 200880120002.7 dated Feb. 07, 2012.
Notice of Allowance from U.S. Appl. No. 11/978,879 dated Mar. 4, 2011.
Examiner's Amendment from U.S. Appl. No. 09/775,759 dated May 23, 2002.
Notice of Allowance from U.S. Appl. No. 09/775,759 dated Mar. 20, 2002.
Notice of Allowance from U.S. Appl. No. 09/811,222 dated Apr. 24, 2002.
Notice of Allowance from U.S. Appl. No. 09/952,004 dated Jan. 14, 2003.
Notice of Allowance from U.S. Appl. No. 10/076,673 dated Dec. 17, 2003.
Office action from U.S. Appl. No. 10/874,117 dated May 23, 2006.
Notice of Allowance from U.S. Appl. No. 10/874,117 dated Sep. 19, 2006.
Office Action from Mexican Application No. 10/04795 dated Jul. 13, 2012 along with English translation of relevant portions of the Action.
Written Opinion from PCT/EP02/00954 dated Oct. 23, 2002.
Supplemental Notice of Allowance from U.S. Appl. No. 09/775,759 dated May 23, 2002.
Office action from Canadian Application No. 2,371,331 dated Nov. 28, 2008 along with English translation of relevant portions of action.
Office action from Canadian Application No. 2,458,768 dated Aug. 4, 2009.
Communication from European Application No. 02290279.5 dated Feb. 15, 2005.
Communication from European Application No. 02290279.5 dated Feb. 15, 2003.
Search Report from French Application No. 01/02991 dated Oct. 29, 2001.
Office action from Canadian Application No. 2,458,768 dated Nov. 19, 2009.
Office action from Canadian Application No. 2,458,768 dated Sep. 04, 2008.

* cited by examiner

APPARATUS FOR AND PROCESS OF FILLING A MUFFLER WITH FIBROUS MATERIAL UTILIZING A DIRECTIONAL JET

TECHNICAL FIELD AND INDUSTRIAL APPLICABILITY OF THE INVENTION

This invention relates generally to the muffler production field and, more particularly, to a novel apparatus and a novel process of filling a muffler with texturized fibrous material utilizing a directional air jet.

BACKGROUND OF THE INVENTION

Exhaust mufflers often include a sound absorbing material within the interior of the muffler to absorb and attenuate the sound made by the escaping gases that pass through the muffler. Many types of exhaust mufflers are produced by mechanically joining multiple pieces to form a muffler shell. For example, one common type of exhaust muffler is known as a spun muffler. Spun mufflers are made by forming a sheet of material into the desired shape to form the muffler body and attaching end caps to this body by welding or crimping to form the muffler shell. Another common type of exhaust muffler is a clamshell muffler, which is assembled by joining an upper section to a lower section by welding or crimping. Both spun mufflers and clamshell mufflers are generally divided into multiple chambers by baffles, or partitions, and contain perforated inlet and outlet pipes that span between the chambers to input and exhaust the gases from the muffler.

A common material used to fill exhaust mufflers is continuous fibrous materials. The fibers usually fill one or more of the muffler chambers, and are often inserted into the muffler in a texturized, or "bulked up" form. In one approach, the bulked up fibers are forced into the assembled muffler shell through either the inlet or outlet pipe. For best performance, it is important to provide generally uniform distribution and filling density of the bulked up fibers when they are forced into the cavities of the assembled muffler shell. There is a need for an improved muffler filling method that better performs this function.

SUMMARY OF THE INVENTION

In accordance with the purposes of the present invention as described herein, an improved nozzle is provided for delivering texturized fibrous material into a chamber of a muffler. The nozzle comprises a body having (a) a texturized fibrous material passageway having an outlet port for directing the texturized fibrous material along a first path and (b) a directional jet passageway having an outlet orifice for directing a directional jet along a second path that intercepts the first path so as to redirect the texturized fibrous material into a desired filling direction. The body of the nozzle may further include an end cap. The end cap forms a cross flow channel portion of the directional jet passageway.

More specifically, the nozzle includes an inlet end, a distal end and an axis A extending from the inlet end to the distal end. The first path forms an angle B with the axis A while the second path forms an angle C with the axis A where C<B. In one particularly useful embodiment that ensures smooth, consistent and uninterrupted delivery of the texturized fibrous material while at the same time providing a more uniform distribution and filling density of a muffler chamber, the angle B is ≥90° while the angle C≤45°. With this geometry the desired filling direction forms an acute angle with the axis A to allow more efficient filling of the muffler chamber.

In accordance with another aspect of the present invention a method of filling a chamber of a muffler with texturized fibrous material is provided. That method includes the steps of extending a into the muffler so that a nozzle on the wand is received in a chamber, discharging a stream of texturized fibrous material into the chamber from a first passageway of the nozzle and discharging a direction jet into the stream of texturized fibrous material from a second passageway of the nozzle whereby the stream of texturized fibrous material is redirected into a desired filling direction so as to more efficiently fill the chamber.

More specifically, the method includes discharging the stream of texturized fibrous material at an angle of at least 90° relative to an axis A of the nozzle so as to ensure smooth flow of texturized fibrous material from the nozzle. Further, the method includes redirecting the stream of texturized fibrous material into an acute angle of <90° relative to the axis A by impinging the stream of texturized fibrous material with the directional air stream. By increasing or decreasing the pressure of the directional jet relative to the pressure of the stream of texturized material it is possible to adjust the desired filling direction of the redirected stream of texturized fibrous material. Thus, the method also includes the step of changing the desired filling direction during the process of filling the muffler chamber with texturized fibrous material.

The method also includes the steps of inserting the nozzle into the muffler through a pipe and extending the nozzle from an open end of the pipe so as to project into the chamber. The nozzle is then rotated relative to the axis A while discharging the stream of texturized fibrous material into the chamber. Still further, the method includes the step of sealing an opening in an internal baffle of the muffler by plugging the opening with an end of the nozzle. This functions to hold the texturized fibrous material being delivered through the nozzle in the desired chamber of the muffler.

In accordance with still another aspect of the present invention an apparatus is provided for filling a muffler with texturized fibrous material. The apparatus comprises a texturizing gun, a first air source for providing air under pressure to the texturizing gun and a fibrous material source providing fibrous material to the texturizing gun. In addition, the apparatus includes a second air source, a wand and nozzle assembly having a first passageway for receiving the texturized fibrous material from the texturizing gun and directing a stream of texturized fibrous material into a chamber of the muffler along a first path and a second passageway for receiving air under pressure from the second air source and directing a directional jet along a second path into the stream of texturized fibrous material so as to redirect the stream of texturized fibrous material into a desired filling direction to provide more efficient filling of the chamber. The body of the nozzle further includes an end cap that forms a cross flow channel portion of the second passageway.

Still further the nozzle includes an inlet end, a distal end and an axis A extending from the inlet end to the distal end. The first path forms an angle B with the axis A while the second path forms an angle C with the axis A where C<B. In one particularly useful embodiment the angle B≥90° while the angle C is ≤45°. As a result of this geometry the desired filling direction forms an acute angle with the axis A that is useful in efficiently and evenly distributing texturized fibrous material in the chamber of a muffler.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
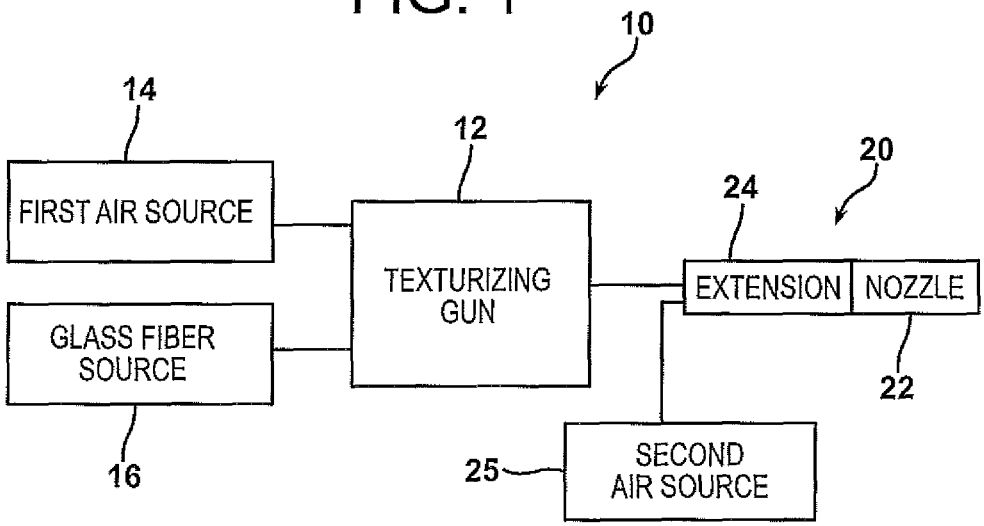
FIG. 1 is a schematical block diagram of the apparatus of the present invention.

Reference is now made to FIG. 1 schematically illustrating the apparatus 10 of the present invention. The apparatus 10 includes a texturizing gun 12 of a type well known in the art for forcing compressed air into contact with the fibrous material and thereby texturizing that material for packing in the chamber of a muffler. Such a texturizing gun 12 is disclosed in, for example, U.S. Pat. No. 5,976,453 (Nilsson et al), owned by the Assignee of the present invention. The entirety of U.S. Pat. No. 5,976,453 is incorporated herein by reference. A first air source 14 of pressurized air and a continuous fibrous material source 16 are all connected to the texturizing gun 12. More specifically, a (multi-filament) rope of fibrous material is fed to the texturizing gun 12 from the fibrous material source 16. The rope of fibrous material is preferably a multi-stranded rope of straight fibrous materials, although it should be appreciated that any suitable fibrous material may be used. As the rope is fed through the texturizing gun 12 it enters a texturizing chamber. A metered flow of pressurized air from the first air source 14 is also introduced into the texturizing chamber.

The compressed air within the texturizing chamber of the texturizing gun 12 separates and tumbles the individual fibrous materials of the rope and the resulting texturized fibrous material is propelled by the compressed air from the texturizing gun into a wand, generally designated by reference numeral 20. Wand 20 is hollow and includes a nozzle 22 and an extension 24. As will be described in greater detail below, the texturized fibrous material from the texturizing gun 12 is conveyed through the wand 20 along a first or texturized material pathway 28 while pressurized air from a second air source 25 passes through the wand along a second or directional jet passageway 30.

Figure 2A:
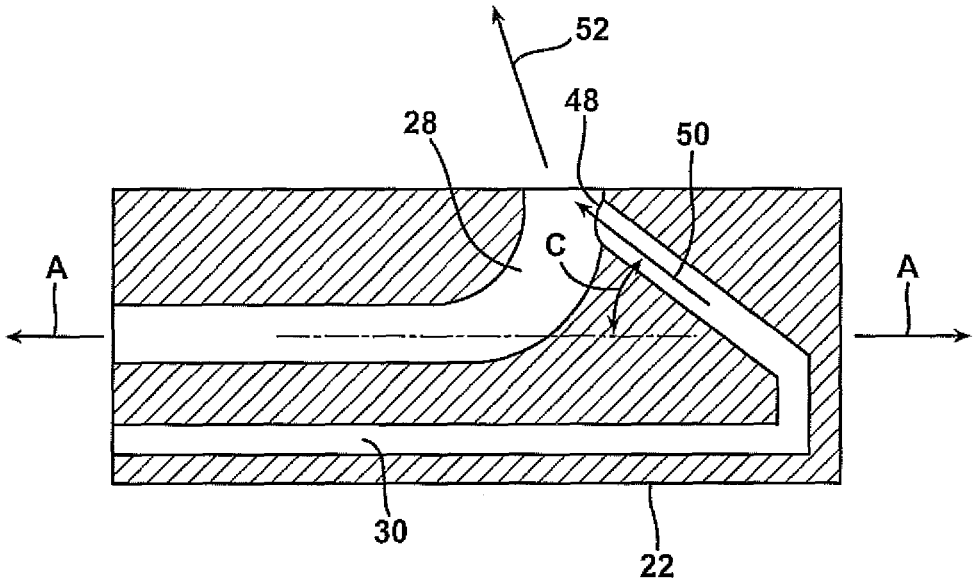
FIG. 2A is a schematical view illustrating the angle C.
Figure 2:
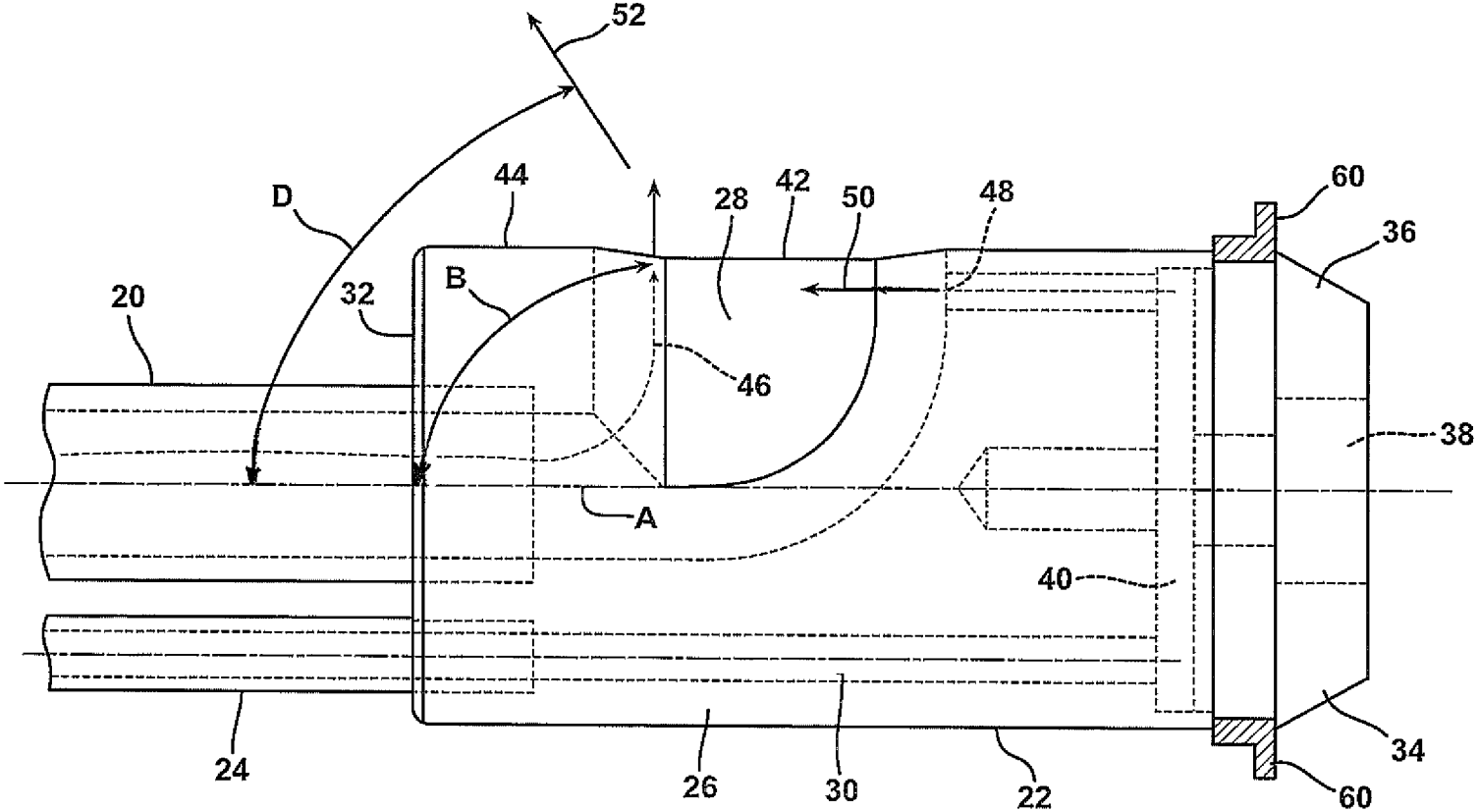
FIG. 2 is a side elevational view illustrating the nozzle and the first and second passageways passing through the nozzle.
Figure 3A:
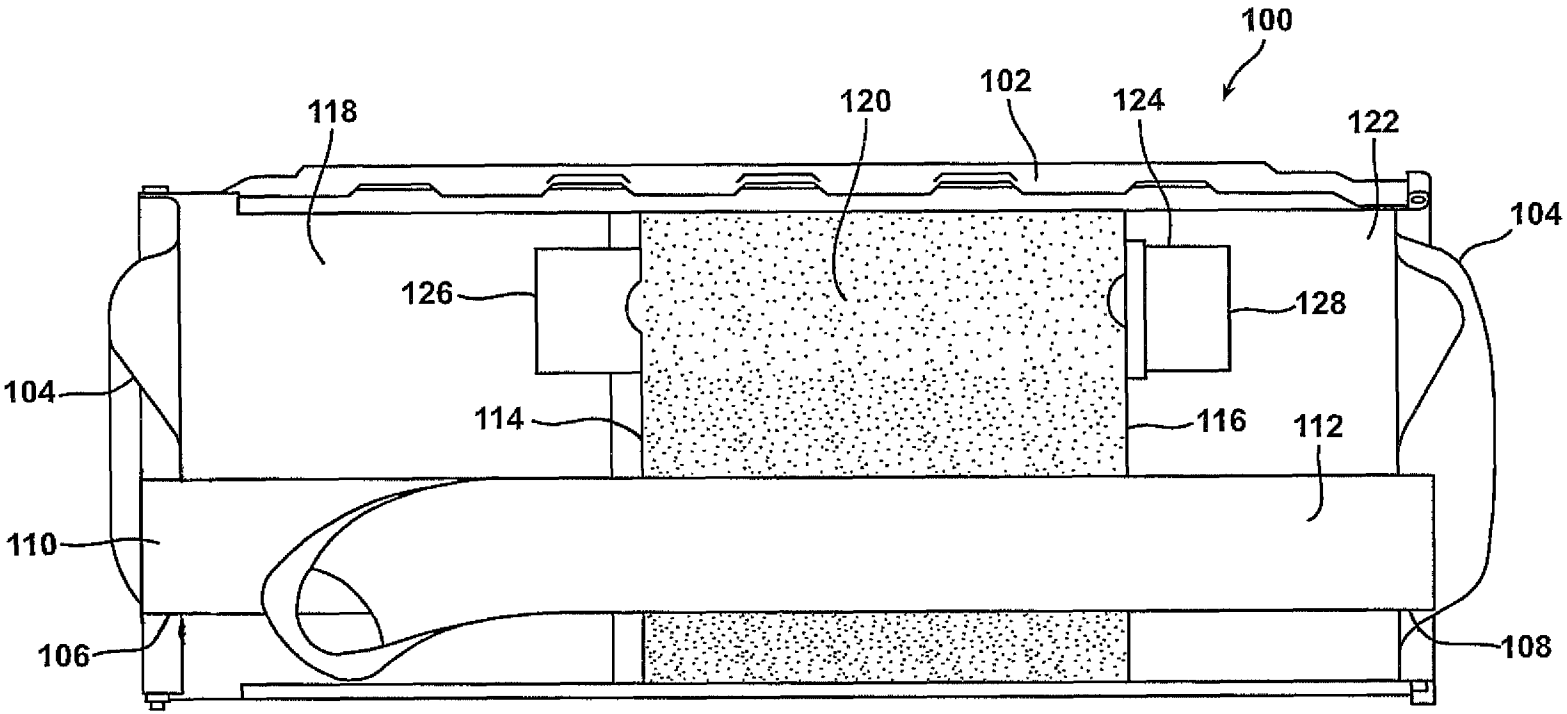
FIGS. 3A and 3B are different schematical cross sectional views illustrating a muffler and the method of the present invention whereby the apparatus is used to fill a chamber of that muffler with texturized fibrous material.
Figure 3B:
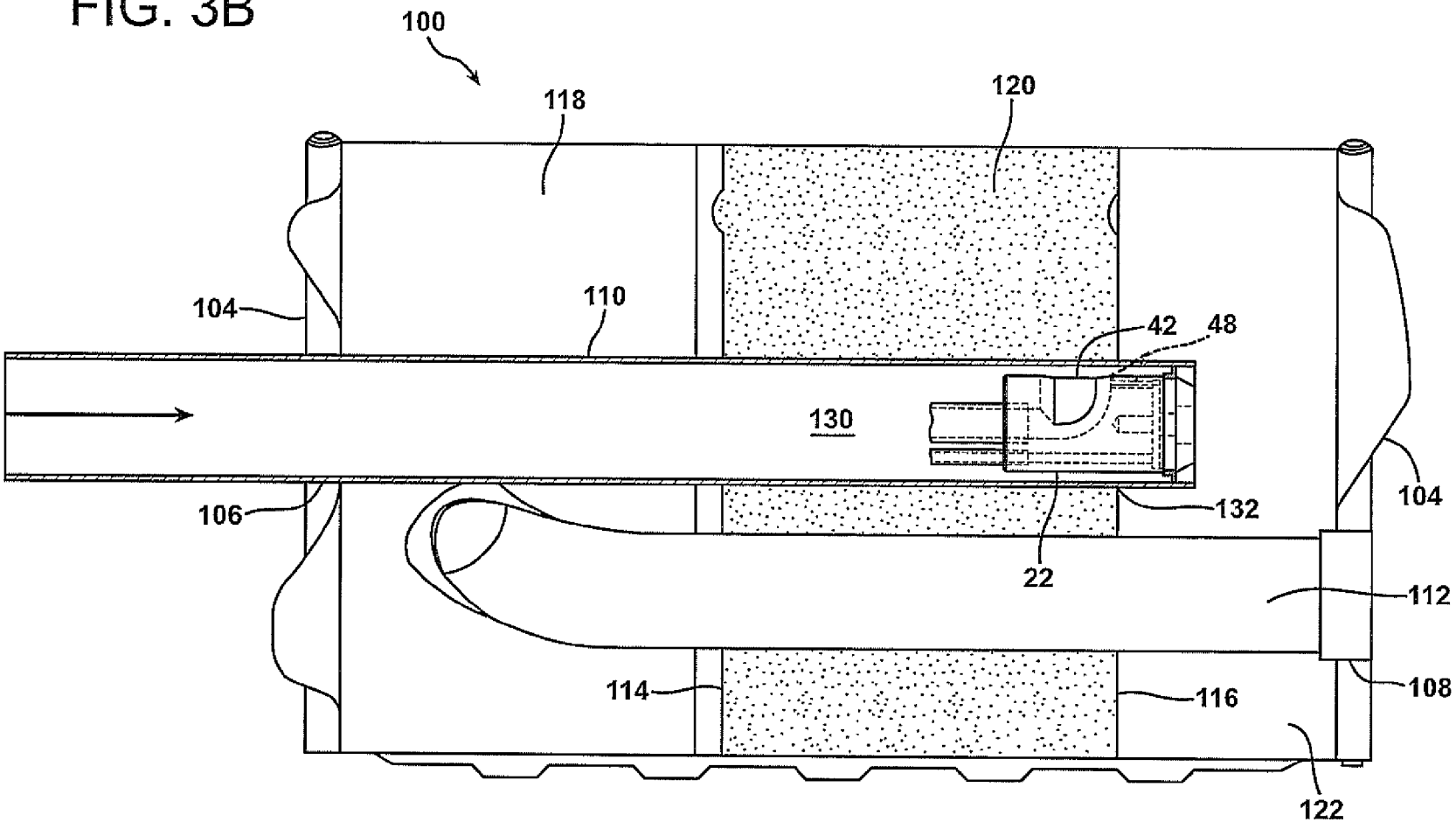

Reference is now made to FIG. 2 showing the nozzle 22 in detail. As illustrated in FIG. 2, the nozzle 22 comprises a main body 26 including the first passageway 28 for the texturized fibrous material and a second passageway 30 to receive pressurized air from the second air source 25. As illustrated, the nozzle 22 includes a proximal or inlet end 32 connected to the extension 24 and a distal end 34 with a longitudinal axis A extending from the proximal end to the distal end. The body 26 also includes an end cap 36 held in place by means of a screw 38. The end cap 36 forms a cross flow channel portion 40 of the second or directional jet passageway 30.

As further illustrated in FIG. 2, the first passageway 28 has an outlet port 42 formed in the side wall 44 of the nozzle 22 so that a stream of texturized fibrous material is discharged along a first pathway 46 that forms an included angle B with the axis A. Typically the included angle B is ≥90°. Although the first passageway is designed to form a 90° angle with axis A, the texturized material tends to escape through the main passageway with a wide open angle (>120°) due to the short radial path.

In contrast, the second passageway 30 includes an outlet orifice 48 that directs the directional jet 50 along a second pathway that intercepts the texturized fibrous material in the first pathway 28 so as to redirect the texturized fibrous material in a new or desired filling direction 52. As illustrated schematically in FIG. 2A, the second pathway and directional jet 50 forms an included angle C of ≤45° with the axis A or a line parallel to axis A. In the embodiment illustrated in FIG. 2, the outlet orifice 48 is positioned in the mouth of the outlet port 42 and the directional jet 50 is directed back along a line parallel to the axis A thereby forming an angle C of 0°.

Together, the geometry of the texturized fibrous material stream of the first pathway 46 and the directional jet of the second pathway 50 ensure that the new direction 52 forms an acute angle D with the axis A. As should be appreciated, the acute angle D of the desired filling direction 52 for the texturized fibrous material ensures that the fibrous material is blown back toward the direction of the extension 24. As will be described in greater detail below this ensures better distribution of texturized fibrous material and more efficient filling of a chamber of a muffler.

The method of the present invention will now be described with reference to drawing FIGS. 3A, 3B, 4A and 4B. Drawing FIGS. 3A and 3B disclose a muffler assembly, generally designated by reference numeral 100. The illustrated muffler assembly 100 is comprised of a main body portion 102 and end caps 104. Generally the body portion 102 and end caps 104 are formed from a metal or metal alloy material, although it should be appreciated that any suitable material may be used for the body portion and end caps. The body portion 102 and end caps 104 can be formed using any suitable forming process, such as forming about a mandrel for the body portion 102 or stamping for the end caps 104. The body portion 102 and the end caps 104 are generally formed such that the completed muffler assembly 100 has an elongated elliptical shape, with the main body portion being joined with the end caps using any suitable method, such as welding or crimping. It should also be appreciated, however, that other shapes and configurations can be used including, for example, clam shell muffler configurations.

In the illustrated embodiment, port openings 106 and 108 are provided in the end caps 104. The port openings 106, 108 can be formed on or in the end caps 104 in any suitable manner. For best possible fiber distribution the openings 106 & 108 should allow for an axial and radial displacement of the nozzle 22. In the illustrated embodiment muffler pipes 110, 112 are received in the port openings 106, 108 respectively.

The muffler assembly 100 generally contains one or more internal structures. In the illustrated embodiment, the muffler assembly 100 includes two baffles 114, 116 that divide the internal cavity of the muffler assembly 100 into three chambers 118, 120, 122. The first chamber 118 is provided between the end cap 104 and the baffle 114. The second or intermediate chamber 120 is provided between the two baffles 114, 116. The third chamber 122 is provided between the baffle 116 and the end cap 104. An internal pipe 124 extends through the two baffles 114, 116 and has a first end 126 in communication with the first chamber 118 and a second end 128 in communication with the third chamber 122. A flanged opening 132 is provided in the baffle 116. The opening 132 is in axial alignment with the opening 106 and is sized and shaped to facilitate insertion and subsequent securing of the pipe 110 in the baffle 116 as described below.

Figure 4A:
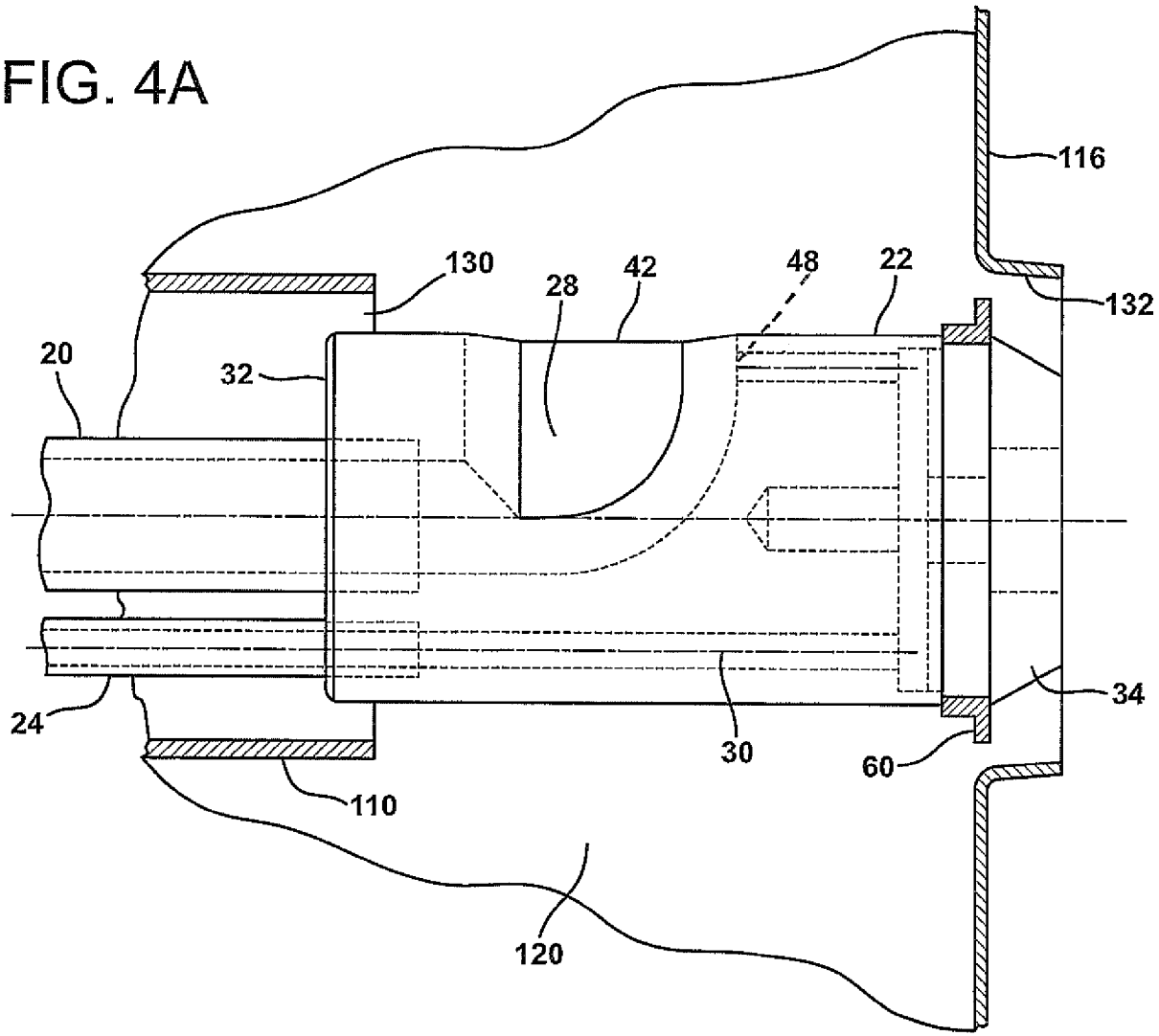
FIGS. 4A and 4B are partially cross sectional and schematical detailed views illustrating the method of the present invention.

The second chamber 120 is filled with texturized fibrous material by inserting the wand 20 into the pipe 110 until the nozzle 22, including the outlet port 42 and outlet orifice 48, extend from the open end 130. As illustrated, the proximal end 32 of the nozzle 22 is held in and substantially closes the end 130 of the pipe. The pipe 110 and wand 20 are then extended into the muffler assembly 100 through the port opening 106. The pipe 110 and wand 20 are advanced until the free or distal end 34 of the nozzle 22 is received in the hole 132 in the baffle 116. As illustrated, the nozzle 22 may carry an optional sealing ring 60 adapted to engage and plug or seal the opening 132 in the baffle 116. As illustrated in FIG. 4A, when the pipe 110 and nozzle 22 are properly positioned in the muffler assembly 100, the proximal end 32 of the nozzle closes the pipe 110, the distal end 34 of the nozzle seals the opening 132 in the baffle 116 by means of the sealing ring 60 and the outlet port 42 of the nozzle is open to the chamber 120. Texturized fibrous material is then discharged to the chamber 120 through the first passageway 28 and outlet port 42 of the nozzle 22. The directional jet is simultaneously provided or discharged through the outlet orifice 48 by passing pressurized air through the second passageway 30. By rotating the wand 20 and nozzle 22 about the axis A and varying the force of the directional jet it is possible to control the direction in which the texturized fibrous material is delivered from the nozzle 22 into the chamber 120. For example, the wand 20 and nozzle 22 may be rotated through 360° or more about the axis A so that texturized fibrous material is discharged upwardly, downwardly and sidewardly in all directions. Thus, it is possible to change the filling direction of the stream of texturized fibrous material during the chamber filling process as necessary to insure the most efficient, effective and uniform filling of the chamber. As noted above, during the filling of the chamber 120 with texturized fibrous material, the end of the nozzle 22 plugs the opening 132 in the baffle 116 to prevent fibrous material from exiting the chamber 120.

Figure 4B:
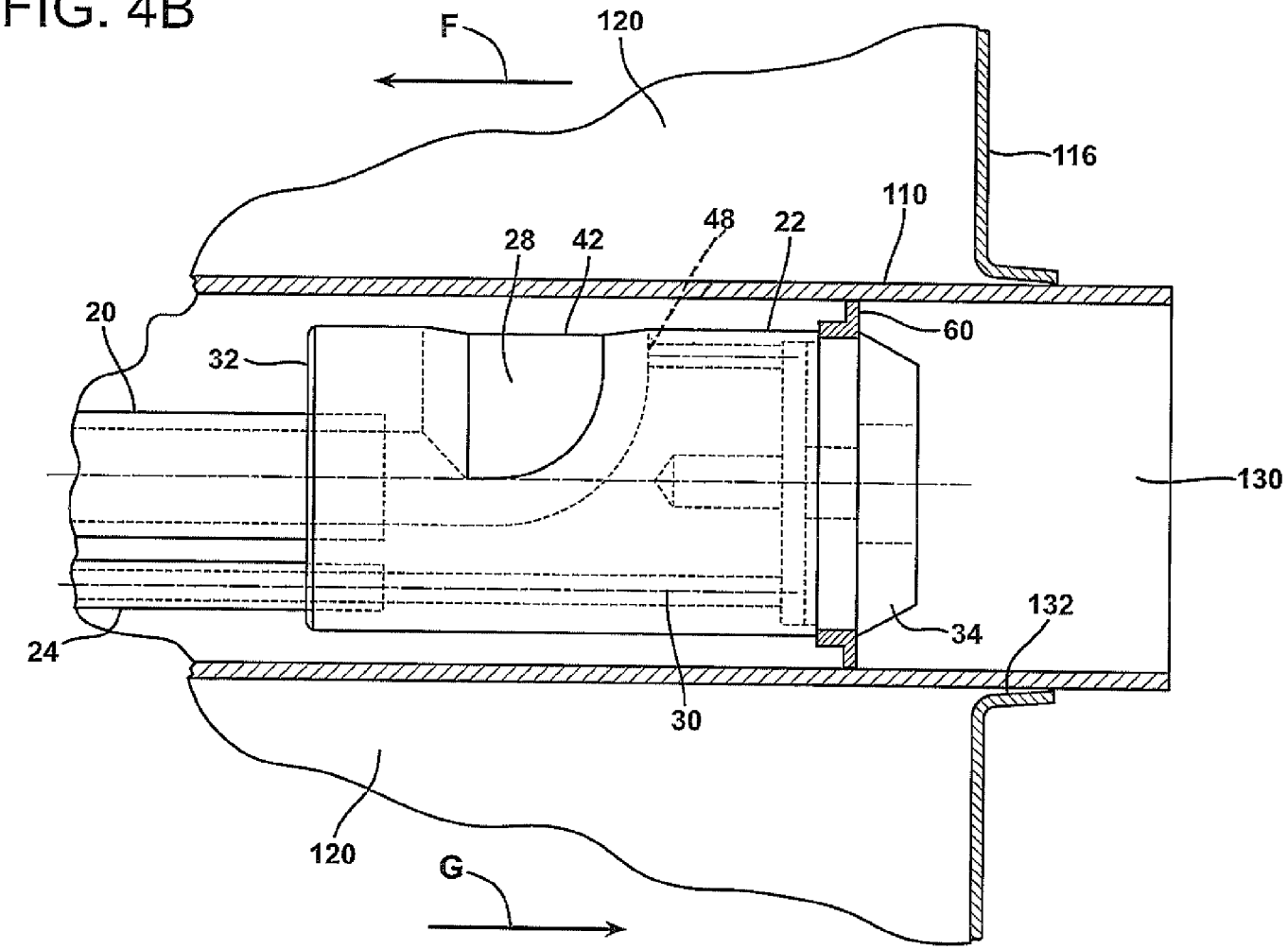

After the chamber 120 has been filled with fibrous material, the wand 20 is pulled back slightly in the direction of action arrow F so as to be retracted into the pipe 110 as the pipe 110 is advanced in the direction of action arrow G so that the end 130 engages the baffle 116 in the margin around the opening 132 (See FIG. 4B). This insures that the fibrous material is maintained in the chamber 120 and doesn't enter the chamber 122. The wand 20 is then fully removed from the pipe 110. The pipe 110 is then connected or anchored to the baffle 116 in the flanged opening 132 by welding, expansion in the opening or other means.

Typically, the texturized fibrous material is delivered through the first passageway 28 and the outlet port 42 from the texturizing gun 12 under a pressure of between about 1 and about 6 bars. In contrast, the directional jet is delivered along the second pathway 50 by directing pressurized air at a pressure of between about 1 and about 8 bars along the second pathway 30 through the outlet orifice 48. The greater the pressure of the directional jet, the more the texturized fibrous material is redirected in an acute angle toward the baffle 114. Since the nozzle 22 is provided adjacent to the baffle 116, the texturized fibrous material now redirected by the directional jet 50 along the filling direction 52 toward the baffle 114 provides a more uniform distribution and filling density of the texturized fibrous material throughout the chamber 120 of the muffler assembly 100.

It should be appreciated that throughout the filling process, air escapes under pressure through the baffles 114, 116 into the chambers 118, 122. Air may freely pass from the chamber 122 to the chamber 118 through the pipe 124 and air from the chamber 118 may pass freely through the pipe 112 to the ambient environment. This prevents a build up in air pressure within the chambers 118, 120, 122 of the muffler assembly 100 that might otherwise slow the filling process or even damage the assembly. It should be appreciated, however, that if desired, a vacuum generator may be connected to the end of the pipe 112 to remove air quickly and aid in feeding texturized fibrous material through the wand 20 into the chamber 120.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. An apparatus for filling a muffler with texturized fibrous material, comprising:

a texturizing gun;

a first air source providing air under pressure to said texturizing gun;

a fibrous material source providing fibrous material to said texturizing gun;

a secondary air source also providing air under pressure; and a wand and nozzle assembly having proximal end and a distal end with an axis A extending between said proximal end and said distal end, said wand and nozzle assembly including:

a first passageway for receiving texturized fibrous material from said texturizing gun and directing a stream of texturized fibrous material toward a chamber of said muffler along a first path; and a second passageway for receiving air under pressure from said second air source and directing a directional jet along a second path into said stream of texturized fibrous material so as to redirect said stream of texturized fibrous material in a desired filling direction, wherein said first passageway is operable to discharge said stream of texturized fibrous material toward said chamber at an angle of at least 90 degrees relative to said axis A, and wherein said desired filing direction resulting from impacting said stream of texturized fibrous material with said directional jet forms an acute angle of less than 90 degrees relative to said axis A.

2. The apparatus of claim 1, wherein said desired filling direction forms an acute angle D with said axis A.

3. The apparatus of claim 1 wherein said second path is parallel to said axis A.

4. A method of filling a chamber of a muffler with texturized fibrous material, comprising:

extending a wand into said muffler so that a nozzle on said wand is received in said chamber, said nozzle including a proximal end and a distal end with an axis A extending between said proximal end and said distal end;

discharging a stream of texturized fibrous material at an angle of at least 90 degrees relative to said axis A toward said chamber from a first passageway of said nozzle; and discharging a directional jet into said stream of texturized fibrous material from a second passageway of said nozzle to redirect said stream of texturized fibrous material into an acute angle of less than 90 degrees relative to said axis A.

5. The method of claim 4, further comprising:

inserting said nozzle into said muffler through a pipe; and extending said nozzle from an end of said pipe so as to project into said chamber.

6. The method of claim 5, including rotating said nozzle about said axis A while discharging said stream of texturized fibrous material.

7. The method of claim 6, further including sealing an opening in an internal baffle of a muffler by plugging said opening with said distal end of said nozzle.

8. The method of claim 7, further including plugging said end of said pipe with said proximal end of said nozzle.

9. The method of claim 4, further including providing said nozzle in said chamber adjacent a first wall and directing texturized fibrous material from said nozzle toward a second, opposite wall so as to more evenly distribute and efficiently fill said chamber in the texturized fibrous material.

10. The method of claim 4, further including increasing or decreasing pressure of said directional jet relative to pressure of said stream of texturized material in order to adjust a filling direction of said redirected stream of texturized fibrous material.

11. The method of claim 10, further including changing said filling direction during filling of said chamber with texturized fibrous material.

* * * * *